US007182635B2

(12) United States Patent
Huang

(10) Patent No.: US 7,182,635 B2
(45) Date of Patent: Feb. 27, 2007

(54) STACKED MICROPHONE JACK ASSEMBLY

(75) Inventor: Chen-Chih Huang, San Chung (TW)

(73) Assignee: Lih Sheng Precision Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/466,456

(22) Filed: Aug. 23, 2006

(65) Prior Publication Data

US 2006/0281362 A1 Dec. 14, 2006

Related U.S. Application Data

(63) Continuation-in-part of application No. 11/160,206, filed on Jun. 14, 2005.

(51) Int. Cl.
*H01R 13/60* (2006.01)

(52) U.S. Cl. ..... 439/541; 439/541.5

(58) Field of Classification Search ..... 439/541.5, 439/540.1, 541, 668, 669, 79
See application file for complete search history.

(56) References Cited

U.S. PATENT DOCUMENTS 4,165,147 A * 8/1979 Buck ..... 439/188
5,051,870 A * 9/1991 Companion ..... 361/773
5,807,120 A * 9/1998 Matthews ..... 439/80
6,116,959 A * 9/2000 Taylor ..... 439/668
6,280,245 B1 * 8/2001 Han ..... 439/541.5

* cited by examiner

*Primary Examiner*—James Harvey
*Assistant Examiner*—Travis Chambers

(57) ABSTRACT

A stacked microphone jack assembly includes two identical microphone jacks each having a housing, which has a front plughole for receiving a microphone plug and two rows of vertical through holes, and conducting terminals each having a head extending to the inside of the housing for the contact of the plug of a microphone and a leg downwardly extending out of the bottom side of the housing, and a connector, which has a base sandwiched between the housings of the two microphone jacks, and a connection terminals respectively fastened to terminal slots on the base, each connection terminal having a clamping portion for clamping the legs of the conducting terminals of the overlying microphone jack respectively and a leg downwardly extending from the clamping portion and respectively inserted through the vertical through holes of the underlying microphone jack.

10 Claims, 10 Drawing Sheets

STACKED MICROPHONE JACK ASSEMBLY

This application is a Continuation-In-Part of my patent application Ser. No. 11/160,206, filed on Jun. 14, 2005.

BACKGROUND OF THE INVENTION

1. Field of the Invention

The present invention relates to microphone jacks and more particularly, to a stacked microphone jack assembly, which uses a connector to connect two identical microphone jacks to form a stacked microphone jack assembly. The microphone jacks can be individually used when detached.

2. Description of the Related Art

Following fast development of high technology, advanced electronic and electric products have been continuously created to improve people's living standard and to promote higher living quality. Among various electronic and electric products, TV, stereo system, CD/DVD/VCD/VDV player are frequently used at home to help people release stress. Further, many electronic and electric products have audio and video plugs for output of audio and video signals to other electronic and/or electric products. Further, an electronic or electric product may be provided with a microphone jack for receiving a microphone for voice input. Two or more microphone jacks may be stacked to save circuit board space and wiring, and installed in an electronic or electric product for receiving two or more microphones.

FIGS. 10 and 11 show a stacked electrical socket assembly constructed according to the prior art. According to this design, two electrical sockets A and B are stacked together, forming a stacked electrical socket assembly. The underlying electrical socket A has mounted therein metal contact terminals A1 and A2. The legs A11 and A21 of the metal contact terminals A1 and A2. extend out of the bottom side of the underlying electrical socket A. The underlying electrical socket A further has slots A3 on two opposite lateral sides for receiving the legs B11 and B21 of the metal contact terminals B1 and B2. of the overlying electrical socket B when the overlying electrical socket B is stacked on the underlying electrical socket A.

As shown in FIG. 11, the metal contact terminals B1 and B2. of the overlying electrical socket B each have a bent B11 and B21 to have the associating leg B11 or B21 be aimed at the corresponding slot A3 on the underlying electrical socket A, so that when the legs B11 and B21 of the metal contact terminals B1 and B2. of the overlying electrical socket B are respectively inserted into the slots A3, they are set apart from the legs A11 and A21 of the metal contact terminals A1 and A2 of the underlying electrical socket A. Therefore, this design of stacked electrical socket assembly is still not satisfactory in function and has numerous drawbacks as follows 1. To fit frequently plugging and unplugging of a plug, the metal contact terminals must be made of an expensive metal material having a good resilient characteristic. Because the legs B11 and B21 of the metal contact terminals B1 and B2. of the overlying electrical socket B are relatively longer, a big amount of waste metal material is produced when the metal contact terminals B1 and B2 are made by means of a stamping press. Therefore, the manufacturing cost of these metal contact terminals B1 and B2 is high. If a cheap metal material is used for making these metal contact terminals B1 and B2, the electrical socket B will wear quickly with use.

2. Because the metal contact terminals B1 and B2 of the overlying electrical socket B and the metal contact terminals A1 and A2 of the underlying electrical socket A have different shapes, two different stamping molds should be used, thereby increasing the manufacturing cost and complicating the inventory control.

3. Because the overlying electrical socket B and the underlying electrical socket A have different specifications, the inventory cost is greatly increased. Therefore, this design is not an economic design.

4. The overlying electrical socket B and the underlying electrical socket A must be stacked together for application. When one electrical socket failed, the whole stacked electrical socket assembly becomes useless and must be wholly replaced.

5. During test, the overlying electrical socket B and the underlying electrical socket A must be stacked together for examination. This test procedure is complicated, wasting much time and labor.

Therefore, it is desirable to provide a stacked electrical socket assembly that eliminates the aforesaid drawbacks.

SUMMARY OF THE INVENTION

The present invention has been accomplished under the circumstances in view. According to one aspect of the present invention, two identical microphone jacks can be assembled with a connector to form a stacked microphone jack assembly for the insertion of two microphones. Because the microphone jacks are identical, the parts of the microphone jacks can be modularized for easy fabrication in an economic way.

According to another aspect of the invention, one single design of microphone jacks can be used with one connector to construct a stacked microphone jack assembly. Therefore, the invention facilitates the inventory control of microphone jacks. Further, every individual microphone jack according to the present invention can be independently used.

According to still another aspect of the present invention, the legs of the conducting terminals of the microphone jacks are designed to be relatively shorter than the legs of the connection terminals of the connector. Further, the conducting terminals of the microphone jacks are made of an expensive metal material having the advantages of high structural strength, high resilience work of deformation and long service life, and the connection terminals of the connector are made of a relatively cheaper metal material. This design greatly reduces the terminal material cost without affecting the performance of the stacked microphone jack assembly.

According to still another aspect of the present invention, when the overlying microphone jack of the stacked microphone jack assembly failed, the failed overlying microphone jack can be directly removed from the connector and replaced with a new microphone jack without changing the underlying microphone jack.

According to still another aspect of the present invention, the connector of the present invention can be used one microphone jack and stacked on the microphone jack at the top and then positioned with the underlying microphone jack in respective contacts of the test instrument, and microphone jacks can then be stacked on the connector and tested one after another. Thus, a big amount of microphone jacks can quickly be examined. Therefore, the invention can examine fabricated microphone jacks rapidly and efficiently.

According to still another aspect of the present invention, he connector of the stacked microphone jack assembly keeps the front plugholes of the housings of the two microphone jacks spaced at a sufficient distance so that the plugs of two microphones can be respectively inserted into the front plugholes of the two microphone jacks without interference.

DETAILED DESCRIPTION OF THE PREFERRED EMBODIMENT

Figure 1:
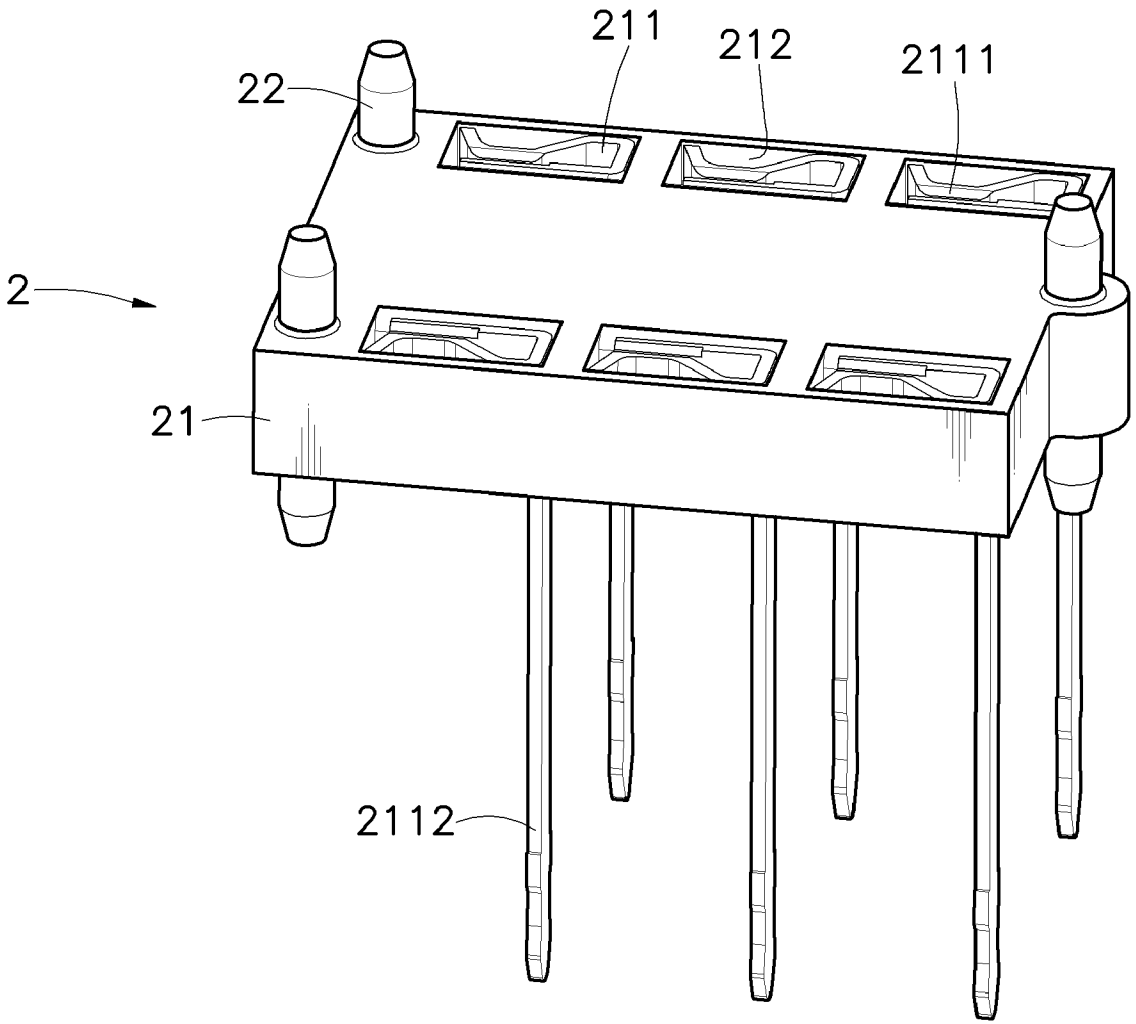
FIG. 1 is an oblique elevation of a connector for stacked microphone jack assembly according to the present invention.
Figure 2:
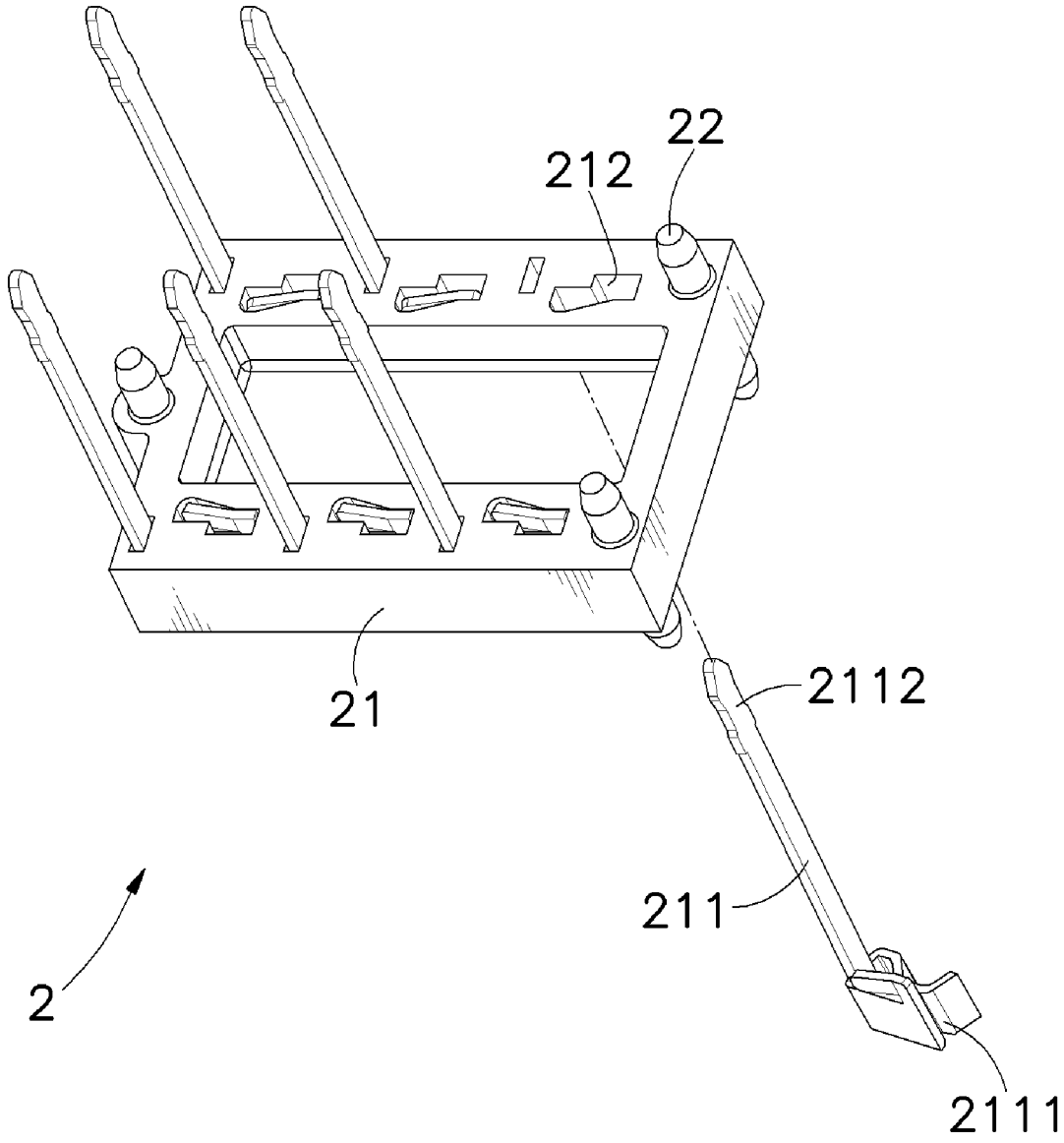
FIG. 2 is an exploded view of a connector for stacked microphone jack assembly according to the present invention.
Figure 3:
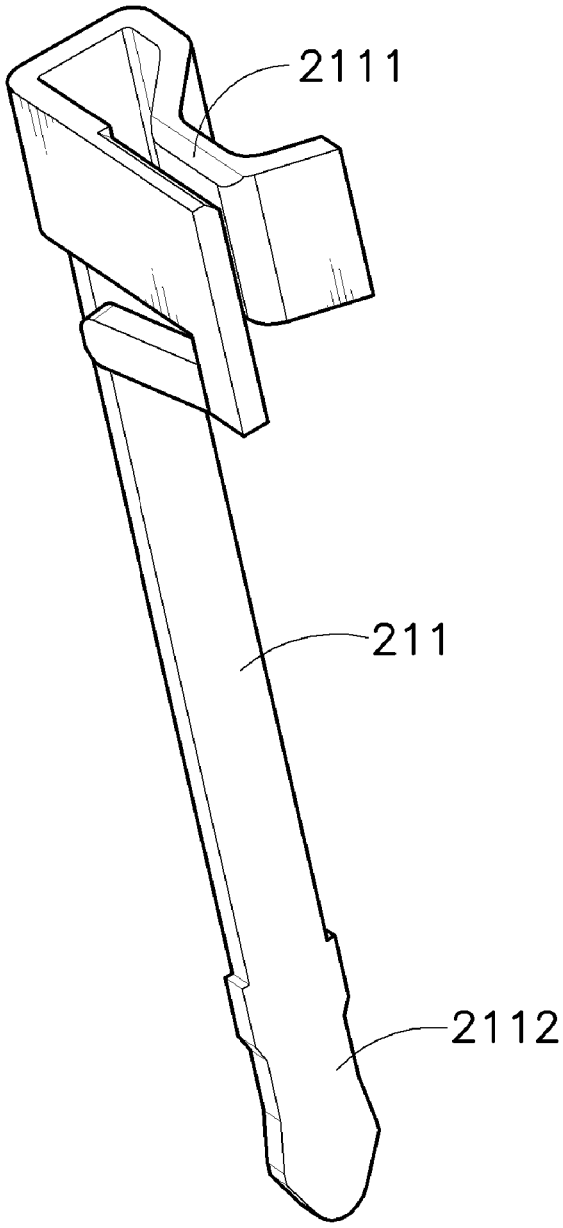
FIG. 3 is an elevational view of a connection terminal for microphone jack according to the present invention.
Figure 4:
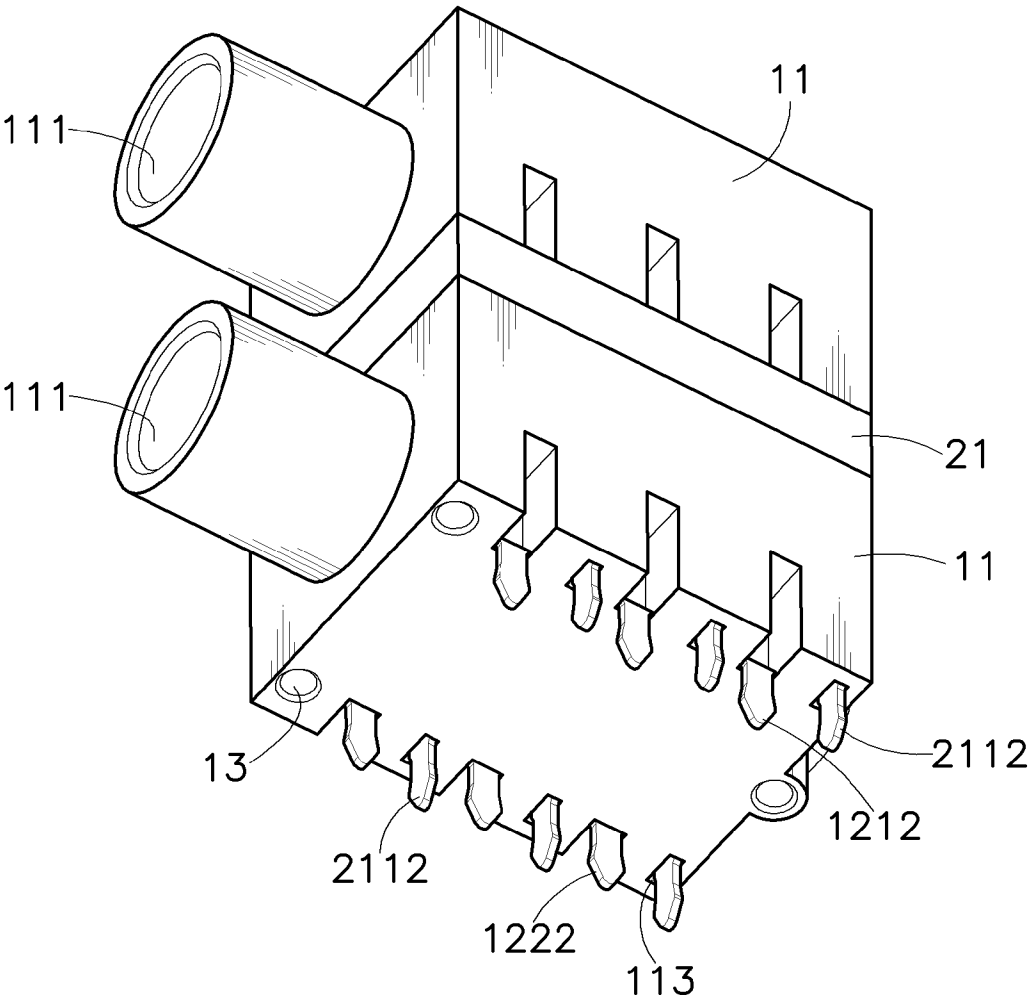
FIG. 4 is an oblique elevation of a stacked microphone jack assembly according to the present invention.
Figure 5:
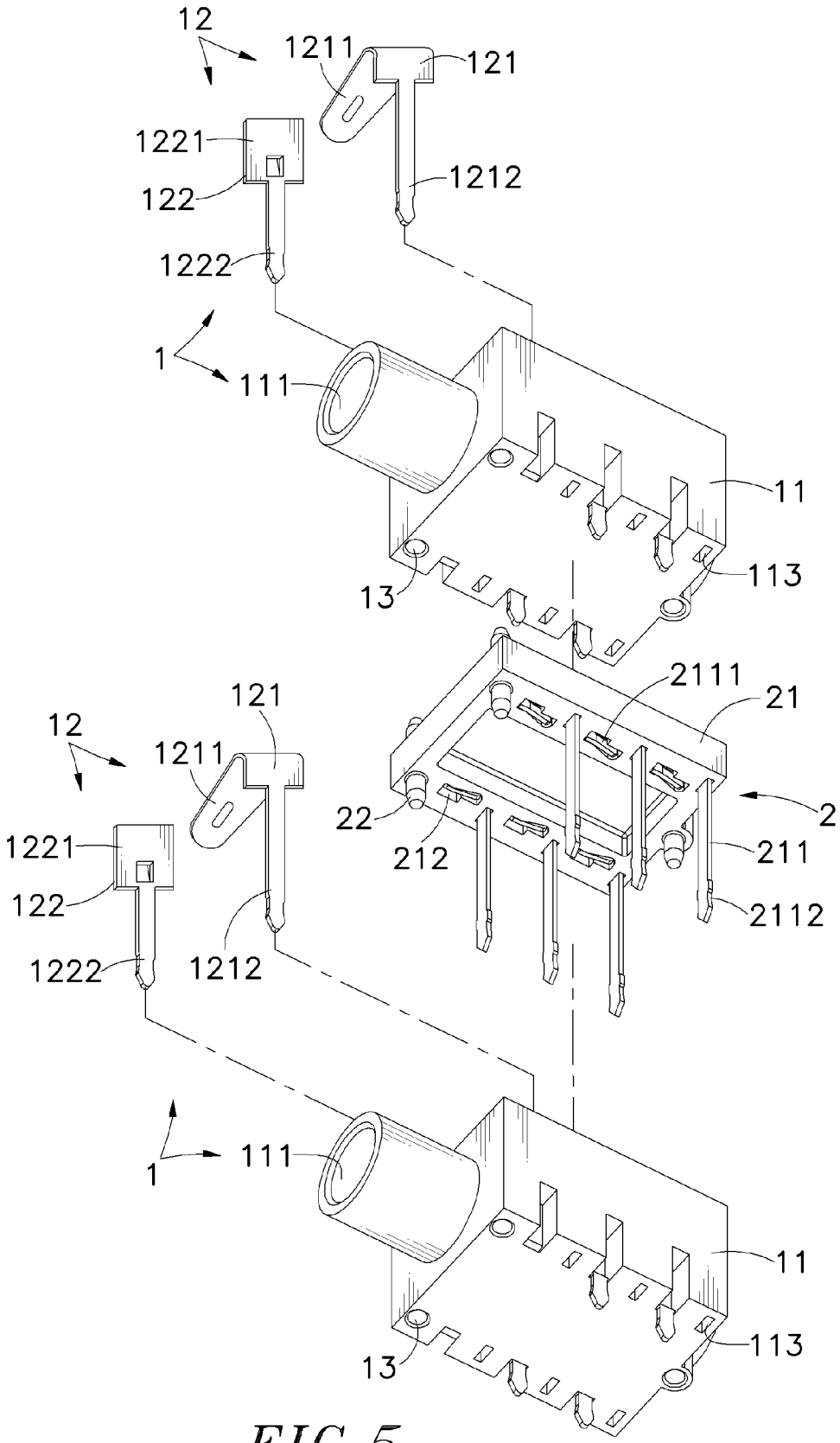
FIG. 5 is an exploded view of the stacked microphone jack assembly shown in FIG. 4.
Figure 6:
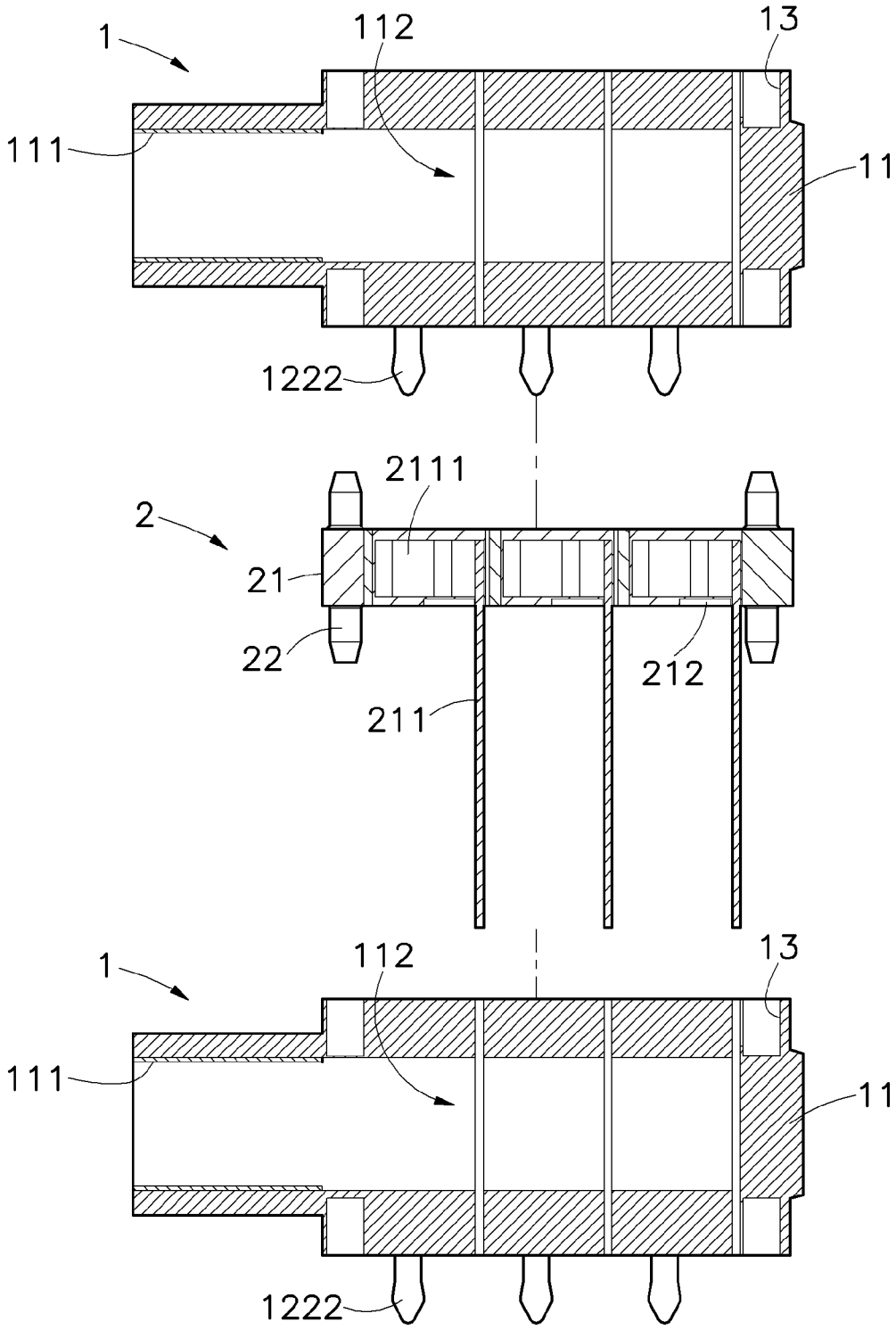
FIG. 6 is a sectional side plain view in an enlarged scale of FIG. 5.

Referring to FIGS. 1~6, a stacked microphone jack assembly in accordance with the present invention is generally comprised of two microphone jacks 1, and a connector 2 electrically connected between the two microphone jacks 1.

The microphone jacks 1 are identical, each comprised of an electrically insulative housing 11 and a set of conducting terminals 12. The housing 11 has an inside chamber 112, a front plughole 111 disposed in communication with the inside chamber 112 at a front side for receiving a microphone plug, and a plurality of vertical through holes 113 vertically cut through the top and bottom walls thereof near two opposite lateral sides. The conducting terminals 12 include contact terminals 121 and detection terminals 122 respectively mounted in the housing 11 at two opposite lateral sides. The contact terminals 121 each have a head 1211 and a leg 1212 downwardly extending from one side of the head 1211. The detection terminals 122 each have a head 1221 and a leg 1222 downwardly extending from one side of the head 1221. The heads 1211 of the contact terminals 121 extend horizontally to the inside of the accommodation chamber 112 and respectively kept in close contact with the heads 1221 of the detection terminals 122.

The connector 2 is electrically connected between the two microphone jacks 1, comprising an electrically insulative base 21, which has a plurality of terminal slots 212 cut through the top and bottom sides thereof and arranged in two rows at two opposite lateral sides, and a plurality of connection terminals 211 respectively fastened to the terminal slots 212. The connection terminals 211 each have a clamping portion 2111 respectively suspending in the terminal slots 212, and a leg 2112 downwardly extending from one side of the clamping portion 2111 outside the base 21. Further, the terminal slots 212 of the connector 2 are arranged in an offset manner relative to the vertical through holes 113 of the housings 11 of the microphone jacks 1.

During installation, the legs 1212 and 1222 of the contact terminals 121 and detection terminals 122 of one microphone jack 1 are respectively inserted into the terminal slots 212 of the connector 2 and kept electrically connected to the clamping portion 2111 of the connection terminals 211 of the connector 2. Thus, one microphone jack 1 is stacked on the connector 2. Thereafter, the legs 2112 of the connection terminals 211 are respectively inserted through the through holes 113 of the other microphone jack 1 out of the bottom side of the other microphone jack 1. Thus, the stacked microphone jack assembly is assembled.

Referring to FIG. 5 again, the conducting terminals 12 of the microphone jacks 1 are respectively stamped from a metal plate. The legs 1212 and 1222 of the conducting terminals 12 are so arranged to fit the clamping direction of the clamping portions 2111 of the connection terminals 211 so that the clamping portions 2111 of the connection terminals 211 clamp the legs 1212 and 1222 of the conducting terminals 12 positively, i.e., the width of the legs 1212 and 1222 of the conducting terminals 12 extends in longitudinal direction to fit the longitudinally extending direction of the clamping portions 2111 of the connection terminals 211 while the width of the legs 2112 of the connection terminals 211 extend in transverse direction to fit the through holes 113 of the housing 11.

Further, to fit frequently plugging and unplugging of a microphone plug, the conducting terminals 12 must have a good resilient characteristic. Therefore, the conducting terminals 12 are respectively made of a certain thickness of resilient metal plate having the advantages of high structural strength, high resilience work of deformation, and long service life. However, a metal material having these characteristics is expensive. In order to save the cost, the invention has the legs 1212 and 1222 of the conducting terminals 12 of the microphone jacks 1 made relatively shorter than the legs 2112 of the connection terminals 211 of the connector 2, and the connection terminals 211 of the connector 2 are made of a relatively cheaper metal material. This design greatly reduces the terminal material cost without affecting the performance of the stacked microphone jack assembly.

Further, mounting rods 22 are respectively provided at the top and bottom sides of the base 21 of the connector 2, mounting holes 13 are respectively formed on the housings 11 of the microphone jacks 1 for receiving the mounting rods 22 of the connector 2. When stacking the microphone jacks 1 and the connector 2, the top and bottom mounting rods 22 of the connector 2 are respectively plugged into the mounting holes 13 of the microphone jacks 1 to stabilize the connection.

Further, when testing the quality of fabricated microphone jacks 1, the connector 2 is stacked on one microphone jack 1 at the top and then positioned with the underlying microphone jack 1 in respective contacts of the test instrument (not shown), and then each microphone jack 1 to be tested is then stacked on the connector 2 and tested. After test of one microphone jack 1, a second microphone jack 1 is stacked on the connector 2 and tested, and so on. Thus, a big amount of microphone jacks 1 can quickly be tested. Therefore, the invention can test fabricated microphone jacks 1 rapidly and efficiently.

Figure 7:
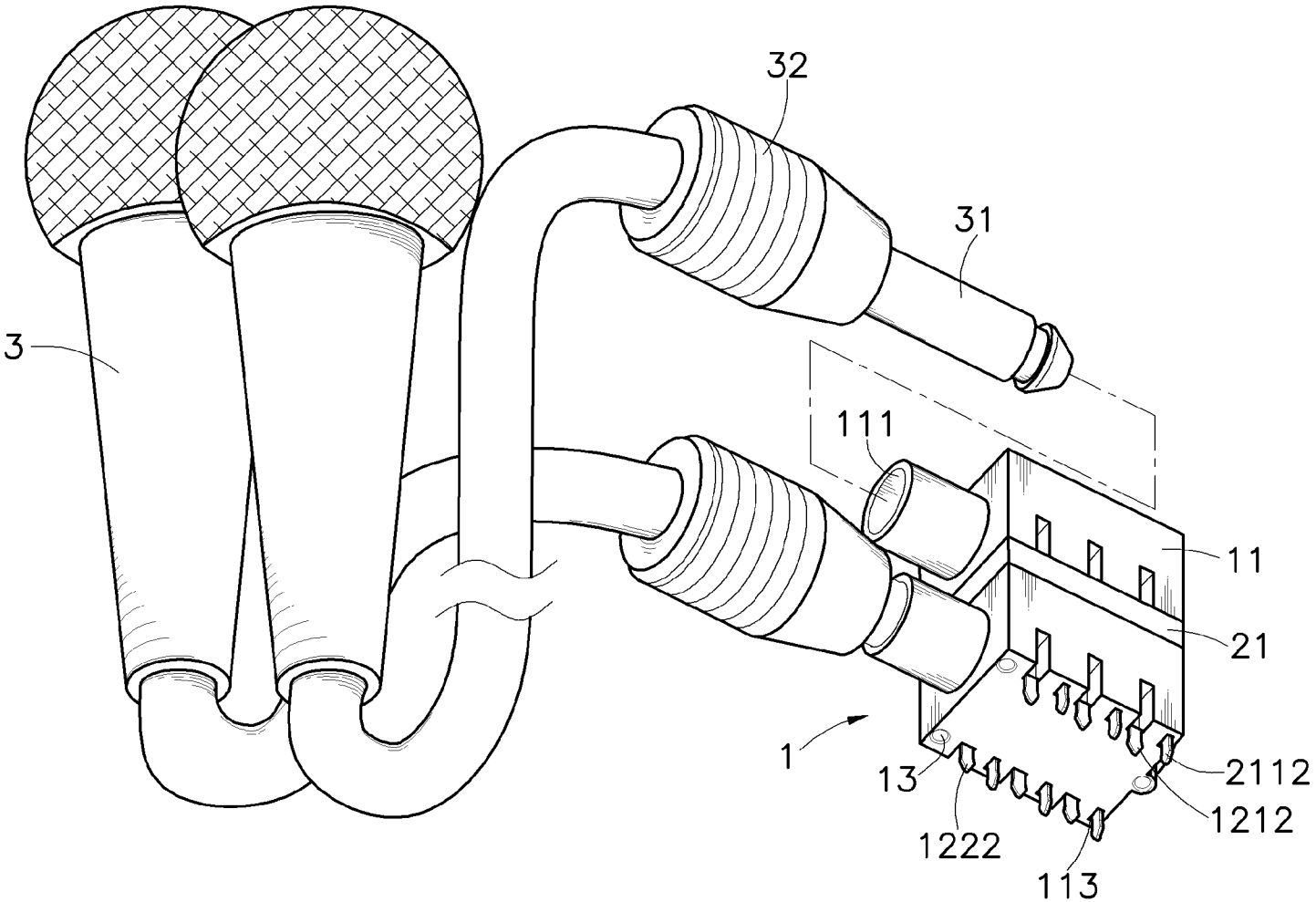
FIG. 7 is a schematic drawing showing a status of use of the present invention.
Figure 9:
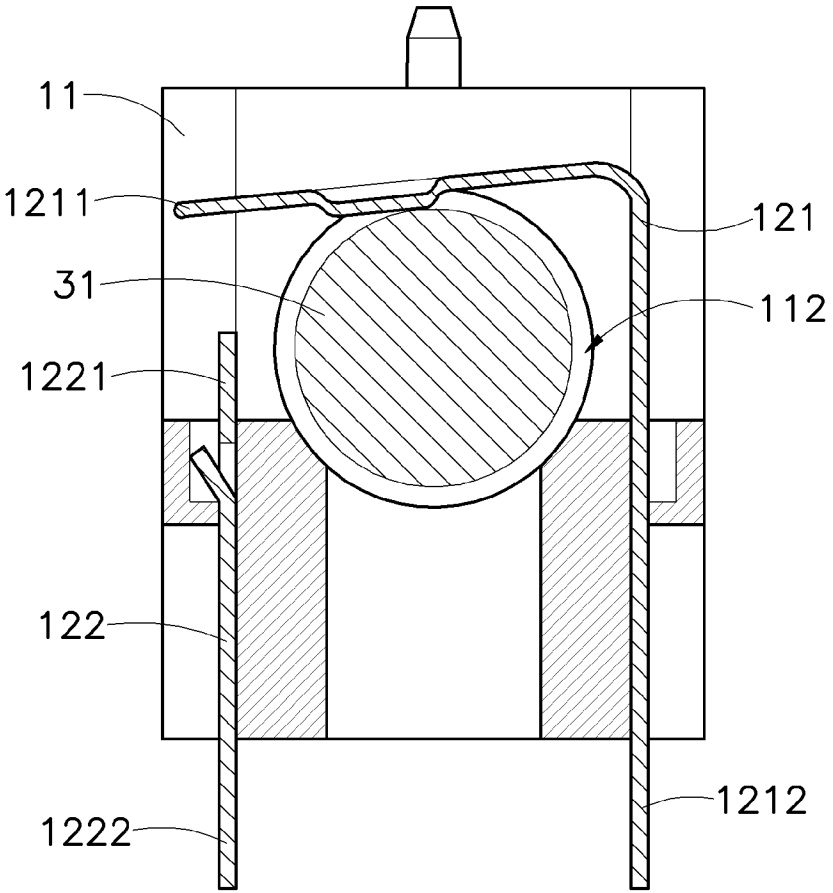
FIG. 9 is similar to FIG. 8, but showing the plug of a microphone inserted into the accommodation chamber of the housing.
Figure 8:
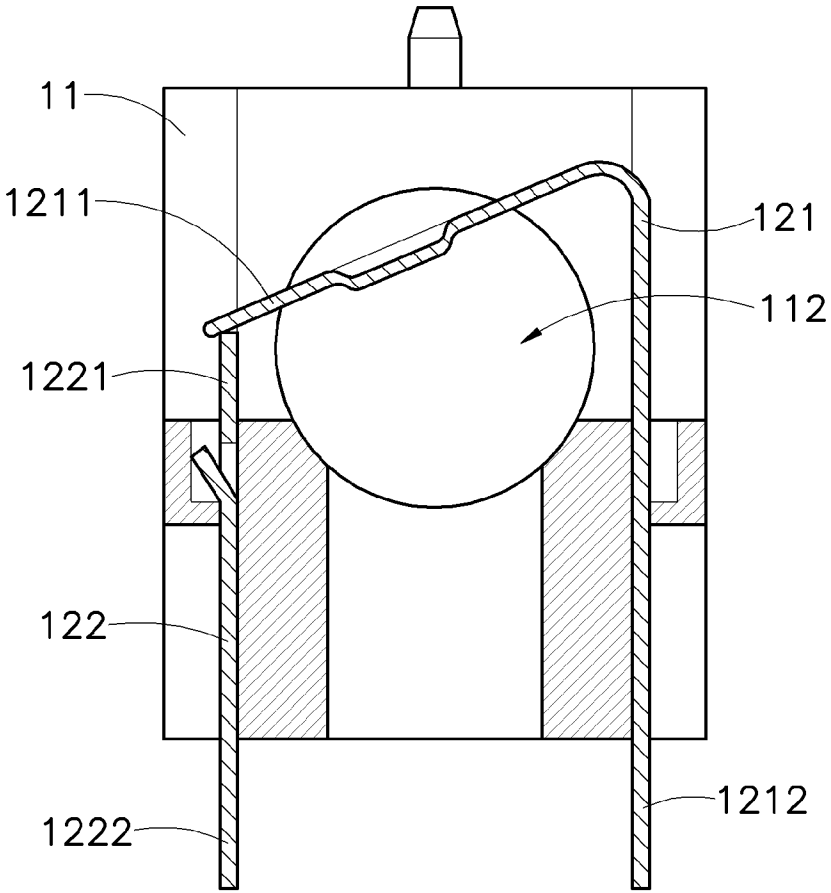
FIG. 8 is a schematic sectional view of a part of the stacked microphone jack assembly according to the present invention, showing the arrangement of the terminals in the accommodation chamber of the housing of the microphone jack before insertion of the plug of a microphone.
Figure 10:
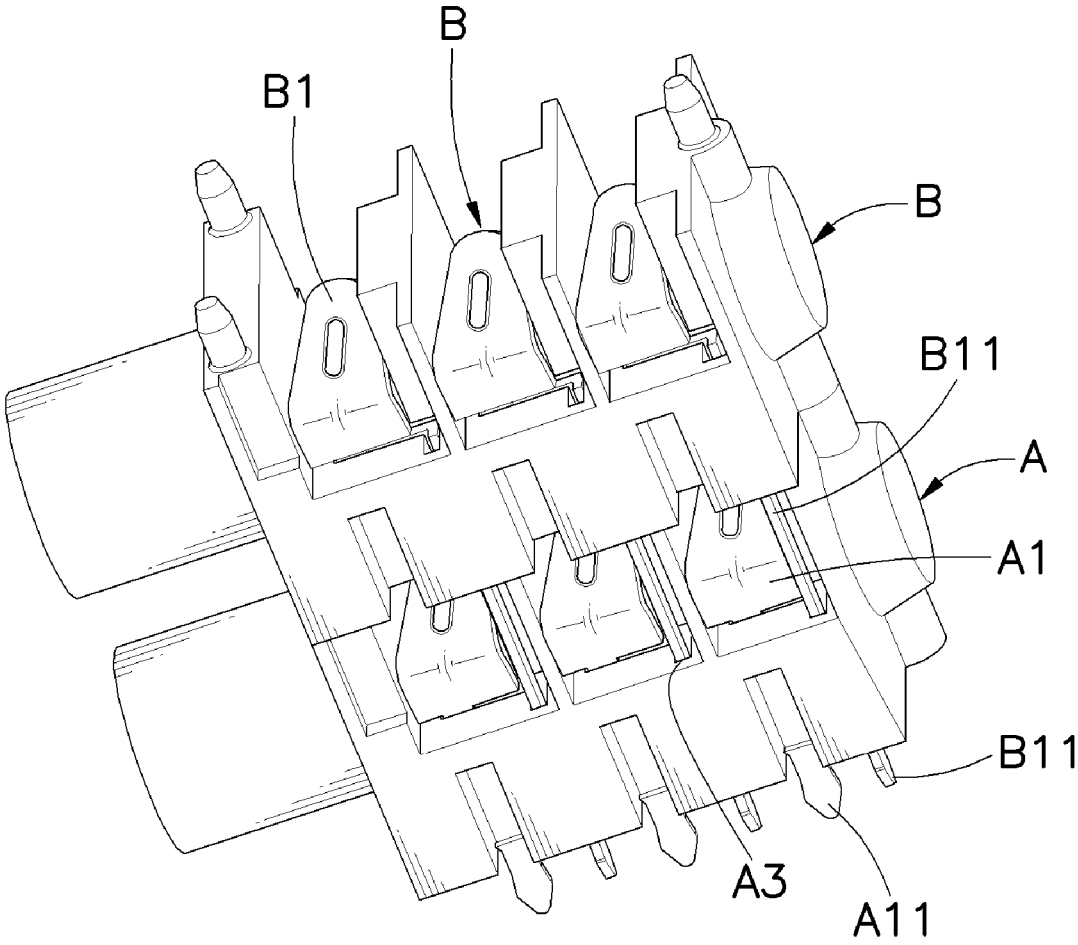
PRIOR ART FIG. 10
FIG. 10 is an elevational view of a stacked electrical socket assembly according to the prior art.
Figure 11:
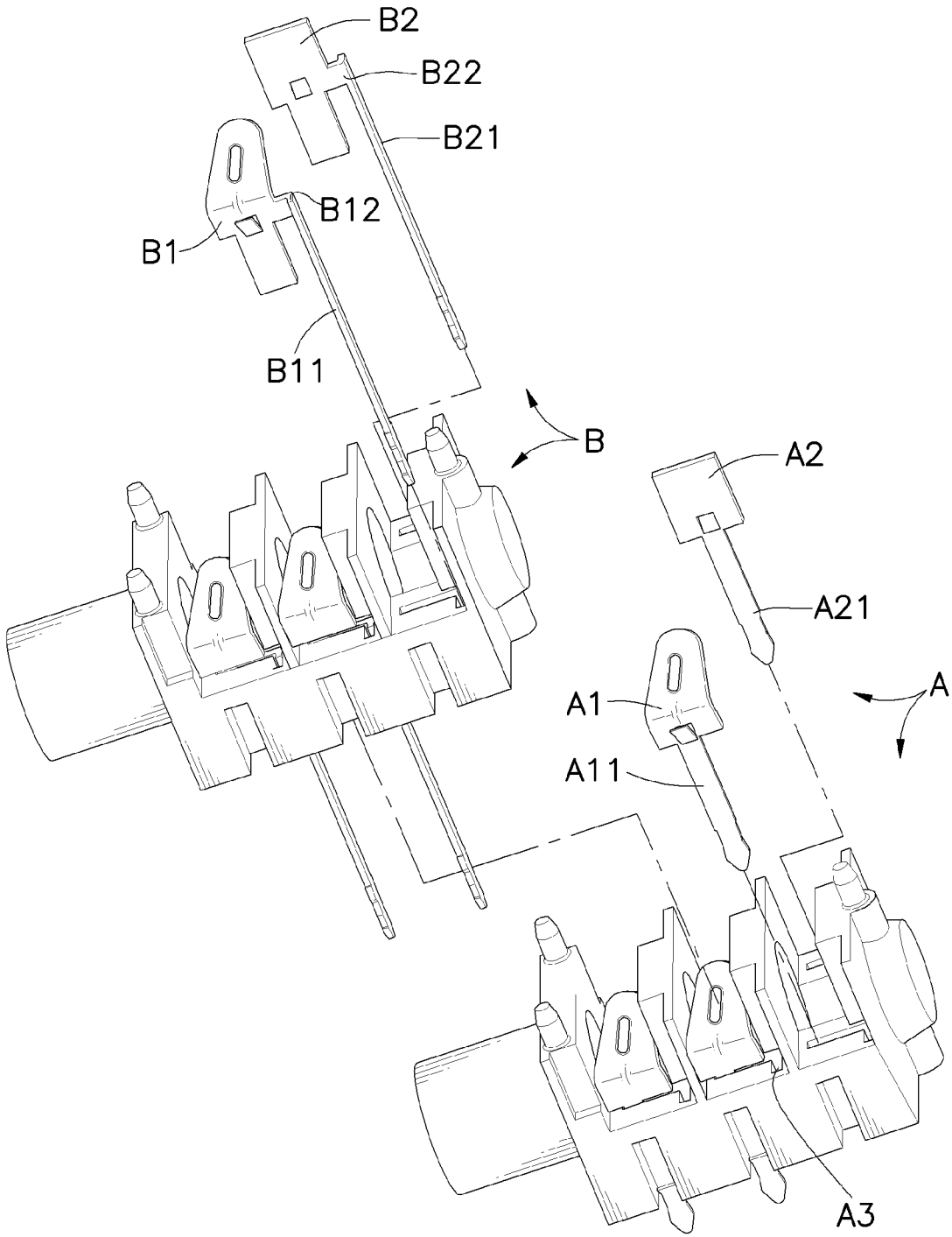
PRIOR ART FIG. 11
FIG. 11 is an exploded view of the stacked electrical socket assembly according to the prior art.

FIGS. 7~9 show an application example of the stacked microphone jack assembly according to the present invention. The stacked microphone jack assembly is installed in an audio apparatus, for example, a stereo system, Karaoke system, CD/VCD/DVD player, or the like, so that the plugs 31 of microphones 3 can be respectively inserted into the front plugholes 111 of the housings 11 of the microphone jacks 1 respectively. When the plug 31 of one microphone 3 is inserted into the front plughole 111 of one microphone jack 1, the plug 31 pushes the heads 1211 of the contact terminals 121 of the conducting terminals 12 upwardly away from the heads 1211 of the associating contact terminals 121 to switch the conducting terminals 12 from the normal-open contact status to the normal-close contact status to detect whether the associating microphone 3 has been inserted into position or not. Therefore, when one microphone 3 is inserted into the accommodation chamber 112 of the associating microphone jack 1 accurately in position, the plug 31 of the microphone 3 is electrically connected to the contact terminals 121 for signal transmission.

Further, a microphone 3 has a grip 32 at one end of the plug 31 for grasping. However, the grips 32 of different models of microphones 3 from different suppliers may have different diameters. The grips 32 of two microphones 3 may interfere with each other against insertion of the plugs 31 of the two microphones 3 into two stacked microphone jacks constructed according to a conventional design. The connector 2 of the stacked microphone jack assembly keeps the front plugholes 111 of the housings 11 of the two microphone jacks 1 at a distance so that the plugs 31 of two microphones 3 can be respectively inserted into the front plugholes 111 of the two microphone jacks 1 without interference. Further, each individual microphone jack 1 of the present invention can be independently used in an audio apparatus for receiving a microphone.

As indicated above, the invention provides a stacked microphone jack assembly, which has the following benefits:

1. The invention enables two identical microphone jacks to be assembled with a connector to form a stacked microphone jack assembly for the insertion of two microphones. Because the microphone jacks are identical, the parts of the microphone jacks can be modularized for easy fabrication in an economic way.

2. Unlike the conventional design of using two different microphone jacks, the invention uses one single design of microphone jacks. Therefore, the invention facilitates the inventory control of microphone jacks. Further, every individual microphone jack according to the present invention can be independently used.

3. The invention has the legs of the conducting terminals of the microphone jacks designed to be relatively shorter than the legs of the connection terminals of the connector, the conducting terminals of the microphone jacks made of an expensive metal material having the advantages of high structural strength, high resilience work of deformation and long service life, and the connection terminals of the connector made of a relatively cheaper metal material. This design greatly reduces the terminal material cost without affecting the performance of the stacked microphone jack assembly.

4. If the overlying microphone jack failed, the failed overlying microphone jack can be directly removed from the connector and replaced with a new microphone jack without changing the underlying microphone jack.

5. The connector of the stacked microphone jack assembly keeps the front plugholes of the housings of the two microphone jacks spaced at a sufficient distance so that the plugs of two microphones can be respectively inserted into the front plugholes of the two microphone jacks without interference.

6. When examining the quality of fabricated microphone jacks, the connector is stacked on one microphone jack at the top and then positioned with the underlying microphone jack in respective contacts of the test instrument, and microphone jacks to be tested can then be stacked on the connector and tested one after another. Thus, a big amount of microphone jacks can quickly be examined. Therefore, the invention can examine fabricated microphone jacks rapidly and efficiently.

A prototype of stacked microphone jack assembly has been constructed with the features of FIGS. 1~9. The stacked microphone jack assembly functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A stacked microphone jack assembly comprising:

a plurality of microphone jacks vertically aligned at different elevations, said microphone jacks each comprised of an electrically insulative housing and a set of conducting terminals mounted in said housing, said housing having an inside chamber, a front plughole disposed in communication with said inside chamber at a front side for receiving a microphone plug, and a plurality of vertical through holes vertically cut through top and bottom walls thereof and arranged in two rows near two opposite lateral sides, said conducting terminals each having a head extending to the inside of said accommodation chamber for a contact of the plug of a microphone and a leg respectively downwardly extending from said head out of a bottom side of said housing; and at least one connector respectively electrically connected between each two vertically spaced microphone jacks of said stacked microphone jack assembly, said at least one connector each comprising an electrically insulative base, said electrically insulative base having a plurality of terminal slots cut through top and bottom sides thereof and arranged in two rows at two opposite lateral sides, and a plurality of connection terminals respectively fastened to said terminal slots, said connection terminals each having a clamping portion respectively suspending in said terminal slots for clamping the legs of the conducting terminals of the overlying microphone jack respectively and a leg downwardly extending from one side of said clamping portion outside said base for inserting through the vertical through holes of the underlying microphone jack.

2. The stacked microphone jack assembly as claimed in claim 1, wherein said conducting terminals include a plurality of contact terminals and a plurality of detection terminals respectively mounted in said housing at two opposite lateral sides, the heads of said contact terminals extending horizontally to the inside of said accommodation chamber and respectively kept in close contact with the heads of said detection terminals.

3. The stacked microphone jack assembly as claimed in claim 2, wherein the heads of the detection terminals of each of said microphone jacks are moved away from the heads of the associating contact terminals to switch the respective conducting terminals from a normal open contact status into a normal close contact status when the plug of a microphone is inserted into the front plughole of the respective microphone jack.

4. The stacked microphone jack assembly as claimed in claim 1, wherein the terminal slots of said connector are arranged in an offset manner relative to the vertical through holes of the housings of said microphone jacks.

5. The stacked microphone jack assembly as claimed in claim 1, wherein the conducting terminals of said microphone jacks are respectively stamped from a metal plate, and the legs of the conducting terminals of said microphone jacks have a width extending in longitudinal direction to fit the extending direction of the clamping portions of the connection terminals of said at least one connector.

6. The stacked microphone jack assembly as claimed in claim 1, wherein the connection terminals of said at least one connector are respectively stamped from a metal plate, and the legs of the connection terminals of said at least one connector have a width extending in transverse direction to fit the vertical through holes of the housings of said microphone jacks.

7. The stacked microphone jack assembly as claimed in claim 1, wherein the conducting terminals of said microphone jacks and the connection terminals of said at least one connector are made of two different metal materials.

8. The stacked microphone jack assembly as claimed in claim 1, wherein the legs of the conducting terminals of said microphone jacks are shorter than the legs of the connection terminals of said at least one connector.

9. The stacked microphone jack assembly as claimed in claim 1, wherein the housing of each of said microphone jack has a plurality of mounting holes on top and bottom sides thereof; said at least one connector has a plurality of mounting rods on top and bottom sides thereof for fastening to the mounting holes of the housings of said microphone jacks.

10. The stacked microphone jack assembly as claimed in claim 1, wherein when one of said at least one connector is electrically connected between two microphone jacks, the electrically insulative base of the associating connector increases the distance between the front plugholes of the two microphone jacks.

* * * * *